US006016906A

United States Patent [19]

Kruse et al.

[11] Patent Number: 6,016,906

[45] **Date of Patent: *Jan. 25, 2000**

[54] L-CARD

[75] Inventors: Joyce Lynn Kruse, Baltimore; David Frederic Gnadt, Owings Mills, both of Md.

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,632

[22] Filed: Dec. 28, 1995

[51] Int. Cl.[7] ..... A47K 5/08

[52] U.S. Cl. ..... 206/77.1; 206/526; 206/782; 206/783; 229/162

[58] Field of Search ..... 206/77.1, 525.1, 206/526, 499, 434, 782, 783, 775, 228, 497, 485, 461, 806, 524.1; 229/161, 162

[56] References Cited

U.S. PATENT DOCUMENTS

| | | | |
|---|---|---|---|
| 2,286,647 | 6/1942 | Roberts | 229/161 |
| 2,354,098 | 7/1944 | Bamber | 229/161 |
| 2,927,687 | 3/1960 | Sanford | 206/419 |
| 3,056,528 | 10/1962 | Shiels, Jr. | 229/161 |
| 3,273,702 | 9/1966 | Palmer | 206/461 |
| 3,352,474 | 11/1967 | Racer | 229/161 |
| 3,703,982 | 11/1972 | Daughtry | 229/161 |
| 3,904,029 | 9/1975 | Koltz | 206/806 |
| 3,905,474 | 9/1975 | Haibara . | |
| 3,918,583 | 11/1975 | Adams | 206/782 |
| 3,990,578 | 11/1976 | Roeser . | |
| 4,146,127 | 3/1979 | Bayer | 206/485 |
| 4,562,922 | 1/1986 | Midura | 206/781 |
| 4,570,787 | 2/1986 | Forbes, Jr. . | |
| 4,616,751 | 10/1986 | Forbes, Jr. . | |
| 4,655,388 | 4/1987 | Fleming | 229/161 |
| 4,708,284 | 11/1987 | Sutherland et al. | 206/434 |
| 4,867,310 | 9/1989 | Cannon et al. | 206/460 |
| 4,905,820 | 3/1990 | Hart et al. . | |
| 5,020,669 | 6/1991 | Nakagoshi | 206/497 |
| 5,228,564 | 7/1993 | Randeria . | |

FOREIGN PATENT DOCUMENTS

| | | | |
|---|---|---|---|
| 1102160 | 5/1955 | France | 206/461 |
| 67831 | 10/1957 | France | 206/461 |

*Primary Examiner*—Paul T. Sewell
*Assistant Examiner*—Luan K. Bui
*Attorney, Agent, or Firm*—Gerard J. McGowan, Jr.

[57] ABSTRACT

An L-Card for accommodating stacks of articles such as soap bars. The L-Card includes a compartment for receiving promotional items which may be sold with the stacked articles. The rear face of one of the panels forming the compartment advantageously constitutes part of the L-shaped area housing the soap bars.

14 Claims, 3 Drawing Sheets

L-CARD

BACKGROUND OF THE INVENTION

In the always-competitive market for personal washing products, manufacturers are often seeking to provide additional incentives for consumers to purchase their products. Sometimes these incentives take the form of including with the product an additional, promotional item. An example of this would be the inclusion of a razor with the washing product.

Soap bars are often presented to the consumer packaged in so-called "L-Cards." In the L-Card, a sheet of paperboard is folded into the shape of an L along a scoreline. The bars are stacked in multiples with two sides of the stack covered by the two sides of the L-Card. The combination soap bars and L-Card are then shrink wrapped to secure the soap bars in place against the L-Card.

The ordinary L-Card does not readily accommodate promotional items, particularly irregularly shaped promotional items such as razor blades.

Haibara, U.S. Pat. No. 3,905,474 is directed to a packing device including a base sheet of material having at least one foldline and a plastic film disposed in overlying relations with the base sheet. The sheet is bent in one direction at the foldline in order to insert the article and then bent in the opposite direction to draw the plastic film taut over the bent sheet.

Roeser, U.S. Pat. No. 3,990,578 discloses a display package for articles such as batteries which includes a single blank of foldable sheet material. The package comprises a partition and a sling-like member outwardly protruding from the partition and forming an open sided pocket in which the articles are disposed.

Forbes, U.S. Pat. No. 4,570,787 discloses a display card which includes a three-dimensional article-receiving aperture.

Forbes, U.S. Pat. No. 4,616,751 discloses a sleeve adapted to be slid over the flange lid of a primary container wherein the sleeve may support one or more promotional products such as razors.

Hart et al., U.S. Pat. No. 4,905,820 discloses a display carton formed from a one-piece paperboard blank and having a front wall which includes a section forming a well for a holding and supporting a package article.

Randeria, U.S. Pat. No. 5,228,564 discloses display packaging for accepting different size containers and holding them in fixed relative positions so that they are arranged along a common frontal plane.

SUMMARY OF THE INVENTION

The present invention is directed to a package suitable for enclosing soap bars and one or more additional promotional items. The package forms an L-shaped area to accommodate the soap bars, similar to the L-shaped area of L-Cards. However, in addition, the package comprises a compartment in which the promotional item such as a razor or other item can be enclosed. The invention is also directed to a blank for forming a package and to the combination of the package and soap bars.

In a particularly advantageous aspect of the invention, the compartment is formed from front and two side panels and a rear panel and the rear face of the rear panel together with an extended portion of one of the side panels define together the L-shaped area. In accordance with another advantageous aspect of the invention, the top and bottom of the compartment are defined by flaps which are cut from the front panel and which include locking tabs which are lockingly received within apertures or slits in the rear panel. Locking of the tabs of the top and bottom flap to the rear panel keeps the front, rear and one of the side panels squared when the carton is erected.

For a more complete understanding of the above and other features and advantages of the invention, reference should be made to the following detailed description of the preferred embodiments and to the accompanying drawings.

DETAILED DESCRIPTION OF THE INVENTION

Figure 1:
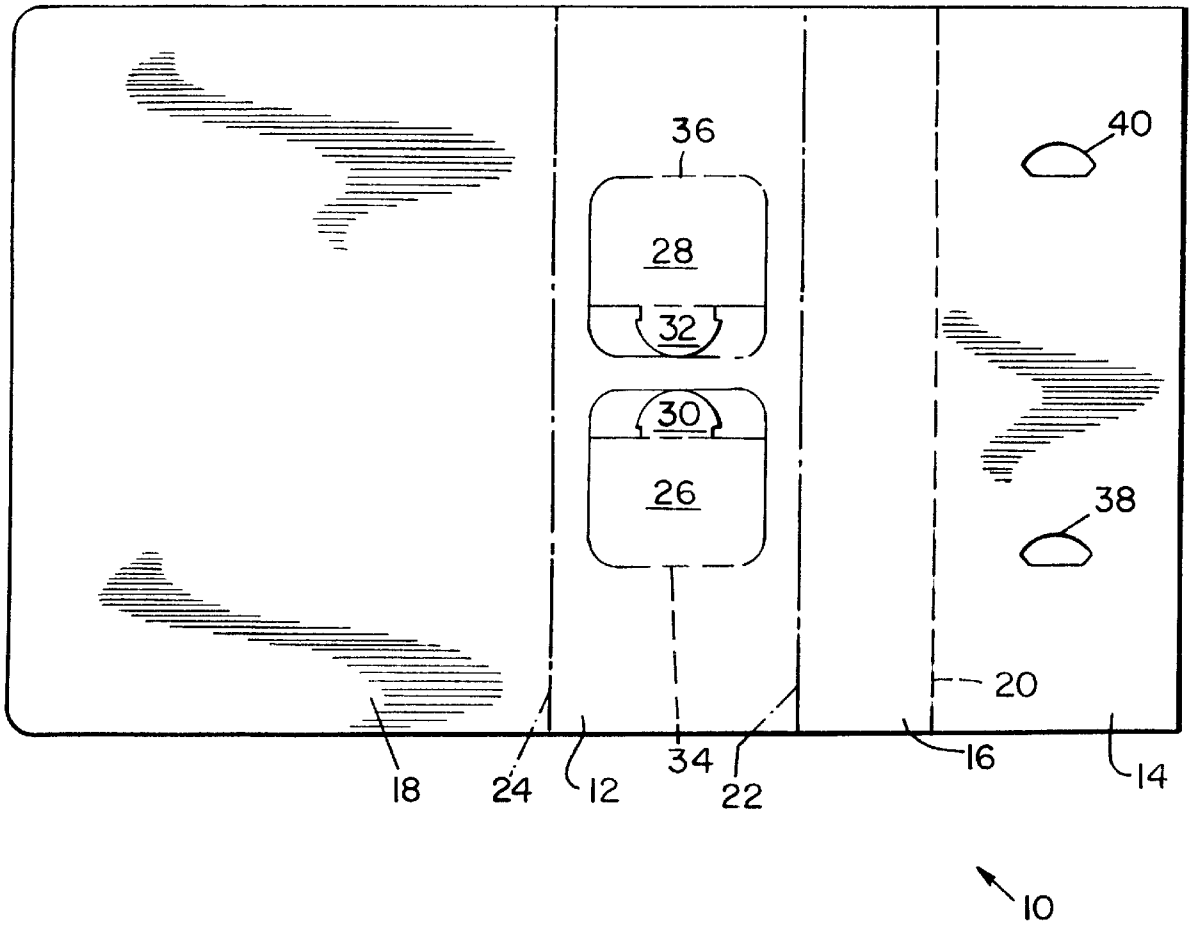
FIG. 1 is a top plan view of a blank according to the invention.

Blank 10 includes front panel 12, rear panel 14, first side panel 16 disposed between the front and rear panels and second side panel 18 opposite panel 16. It will be seen that side panel 18 is substantially longer than first side panel 16, for reasons which will be apparent as the invention is further described.

The blank is preferably made of paperboard or other appropriate packaging materials. Panels 14, 16, 12 and 18 are separated from each other by foldlines or perf/scorelines 20, 22 and 24, which extend transversely of the blank. Perf/scorelines, i.e. foldlines formed by both scoring and perforated cuts along the same line are particularly useful to facilitate folding where heavier materials are used for the blank.

Front panel 12 includes flaps 26 and 28 which are cut from three sides of the front panel. Flaps 26 and 28 are provided respectively with tabs 30 and 32. Flaps 26 and 28 remain attached to front panel 12 at lines 34 and 36.

Rear panel 14 includes locking slots 38 and 40, the diameters of the tabs generally being at least slightly greater than the diameter of the slots.

Figure 4:
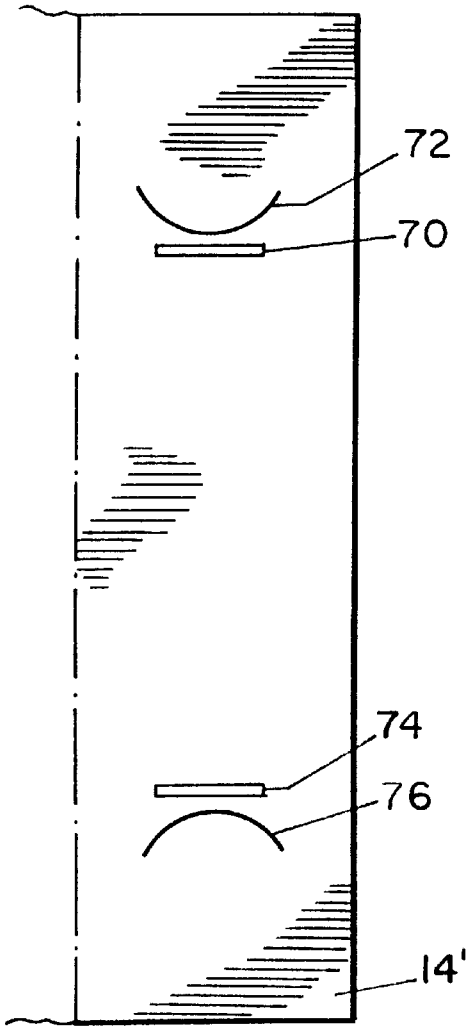
FIG. 4 is a top plan view of a portion of an alternate blank according to the invention.
Figure 5:
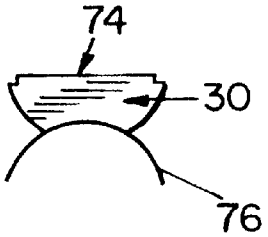
FIG. 5 is an elevational view with parts cut away of a locking feature according to the invention.

In an alternative embodiment shown in FIGS. 4 and 5, panel 14 includes slots 70, 74 and half moon cuts 72, 76. The tabs 32, 30 pass through slots 70, 74 and are folded and inserted behind cuts 72, 76. This keeps tabs 30 and 32 flat and prevents the tabs from interfering with the soap bars or other contents of the L-shaped area.

The package is erected by folding along the transverse foldlines such that rear panel 14 is opposite front panel 12 and first side panel 16 is opposite second side panel 18. Top flap 28 is then folded perpendicularly to front panel 12 after which tab 32 is lockingly placed within slot 40. Likewise bottom flap 26 is placed perpendicularly to front panel 12 and slot 38 lockingly receives tab 30. As a result, flaps 28 and 26 form the top and bottom of a compartment which is further defined by front and rear panels 12 and 14, first side panel 16 and a proximal portion of second side panel 18.

Figure 2:
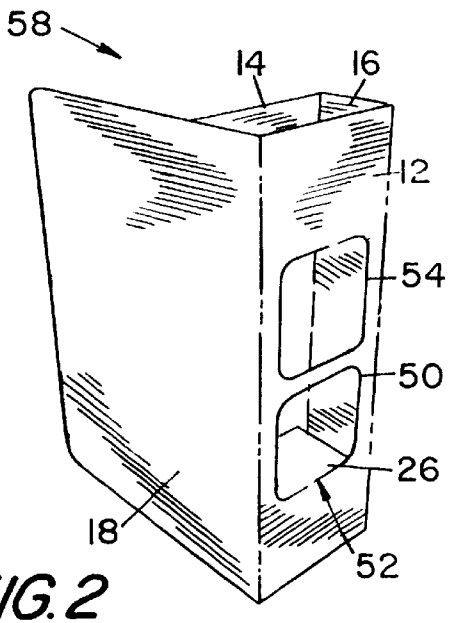
FIG. 2 is a perspective view of the package of the invention as erected.
Figure 3:
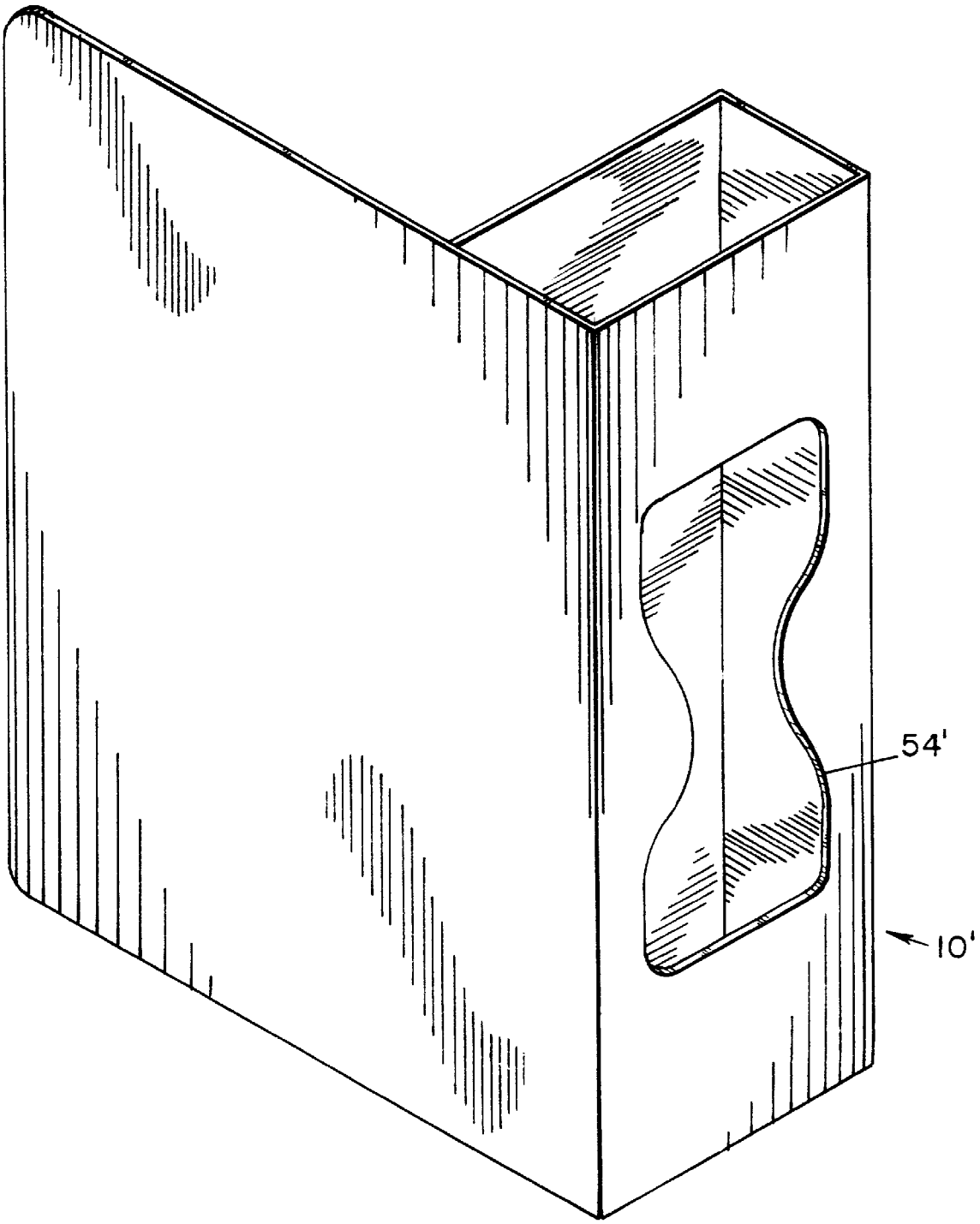
FIG. 3 is a perspective view of an alternate erected package of the invention.

As can be seen in FIG. 2, formation of bottom flap 26 results in aperture 50 through which any product in compartment 52 can be seen. Likewise, formation of top flap 28 (not seen in FIG. 2) results in top display aperture 54 likewise assisting in the display of the promotional product. Folding of flaps 26 and 28 can also result in one aperture 54' by eliminating the section 60 between 50 and 54 as seen for carton 10' in FIG. 3.

The distal, extended portion of second side panel 18 together with the rear of rear panel 14 results in the creation of an L-shaped area 58 which accommodates the stacking of soap or other surfactant bars somewhat in the manner that soap is presently stacked in L-Cards. The L-shaped intersection comprises a reverse side of one of the compartment panels and an extended portion of another of the compartment panels. However, compartment 52 combined with the L-shaped area permits facile packaging of a promotional item such as a razor in combination with the L-shaped area. It is particularly advantageous that this can be achieved by using a single, unitary, integral, one piece carton blank.

Typically, the package including the soap bars and promotional item will be shrink wrapped to secure the soap bars and promotional item within the package. While the package has been described in connection with soap bars, it will be appreciated that other stackable items may be included therein. Soap bars, of course is meant not to be limited to cleansing bars including soaps, i.e. salts of fatty acids, but it will be appreciated that other cleansing bars such as those including synthetic surfactants may be included as well.

It should be understood of course that the specific forms of the invention herein illustrated and described are intended to be representative only as certain changes may be made therein without departing from the clear teachings of this disclosure. Accordingly, reference should be made to the following appended claims in determining the full scope of the invention.

What is claimed is:

1. A package comprising a) a product receiving compartment having an interior, said compartment being defined by top and bottom flaps, opposed front and rear panels and a first side panel disposed between the front and rear panels on one side thereof and a second side panel opposed to said first side panel between said front and rear panels on an opposite side of said front and rear panels from the side at which the first side panel is situated and b) an L-shaped exterior product receiving area exterior to said compartment defined by an L-shaped intersection of walls of said package exterior to said compartment, said package not including further panels or flaps enclosing said exterior product receiving area, said L-shaped intersection comprising a reverse side of one of said compartment panels and an extended portion of another of said compartment panels, soap or other surfactant bars being received within said exterior product receiving area.

2. The package according to claim 1 wherein at least one of said top and bottom flaps is formed from a cut out in said front panel.

3. The package according to claim 1 wherein said rear panel includes first and second sides, said first side facing the interior of said product receiving compartment and said second side forming one wall of said exterior product receiving area.

4. The package according to claim 1 wherein a unitary wall forms one of said first or second side panels and a wall of said exterior product receiving area.

5. The package according to claim 3 wherein a unitary wall forms one of said first or second side panels and a wall of said exterior product receiving area.

6. The package according to claim 2 wherein at least one of said top and bottom flaps is cut from said front panel on three sides and is attached to said front panel along a fourth side.

7. The package according to claim 6 wherein said flap includes a tab and said rear panel includes a slot and tuck tab which lockingly receive said tab.

8. The package according to claim 7 wherein said top and bottom flaps are cut from said front panel and form display windows revealing the contents of said compartment.

9. The package according to claim 1 made from a one-piece blank.

10. A package comprising a) first and second panels meeting at an angle forming generally an L-shaped intersection forming an exterior product receiving area, said package not including further panels or flaps enclosing said exterior product receiving area, and b) a product receiving compartment defined by top and bottom flaps, opposed front and rear panels and a first side panel disposed between the front and rear panels on one side thereof and a second side panel opposed to said first side panel between said front and rear panels on a side opposite to that on which the first side panel is situated, said exterior product receiving area being exterior to said compartment, said L-shaped intersection comprising a reverse side of one of said compartment panels and an extended portion of another of said compartment panels, a product being secured within the exterior product receiving area by shrink wrapping.

11. The package according to claim 10 wherein said rear panel includes a rear face and a front face, said rear face forming one of said first or second panels of said L-shaped intersection and the other of said first or second L-shaped intersection-forming panels being unitary with one of said first or second side panels.

12. A blank comprising a front panel, a first side panel separated from one side thereof by a fold line, a rear panel adjacent said first side panel on a side of said first side panel opposite said front panel, a second side panel on a side of said front panel opposite said first side panel, said second side panel being longer than said first side panel so that when said blank is squared said second side panel extends beyond said rear panel to define between said extending portion of said second side panel and said rear panel a generally L-shaped intersection forming an L-shaped exterior product receiving area, said blank not including further panels or flaps enclosing said exterior product receiving area when said blank is squared, said front panel including at least one flap cut from at least one side thereof, said flap including a tab and said rear panel including a locking aperture for lockingly receiving said tab.

13. The blank according to claim 12 wherein said front panel includes at least two flaps cut from at least one side thereof and adapted to form top and bottom flaps of a compartment when said blank is erected, said compartment being defined by said top and bottom flaps, and said front, rear and first side panel and a portion of second side panel said exterior product receiving area being exterior to said compartment.

14. A package comprising a) first and second panels meeting at an angle forming generally an L-shaped intersection forming an exterior product receiving area, said package not including further panels or flaps enclosing said exterior product receiving area, and b) a product receiving compartment comprising opposed front and rear panels and top and bottom flaps, each cut from said front panel on three sides, and a first side panel disposed between the front and rear panels on one side thereof and a second side panel opposed to said first side panel between said front and rear panels on a side opposite to that on which the first side panel is situated, said exterior product receiving area being exterior to said compartment, said L-shaped intersection comprising a reverse side of one of said compartment panels and an extended portion of another of said compartment panels, said top and bottom flaps each including a tab and said rear panel including slots which lockingly receive said tabs.

* * * * *